US005392709A

United States Patent [19]

Seyffert et al.

[11] Patent Number: 5,392,709

[45] Date of Patent: Feb. 28, 1995

[54] MOUNTING FOR AN IMPRESSION CYLINDER EQUIPPED WITH A TUBE

[75] Inventors: Ulrich Seyffert, Syrau; Hermann Döbler, Plauen, both of Germany

[73] Assignee: MAN Roland Druckmaschinen AG, Offenbach am Main, Germany

[21] Appl. No.: 163,821

[22] Filed: Dec. 8, 1993

[30] Foreign Application Priority Data

Dec. 10, 1992 [DE] Germany ..... 4241566

[51] Int. Cl.[6] ..... B41F 13/28; B41F 27/00

[52] U.S. Cl. ..... 101/216

[58] Field of Search ..... 101/216, 375, 376, 217, 101/218, 247, 479

[56] References Cited

U.S. PATENT DOCUMENTS 3,618,516 11/1971 Jurny ..... 101/218

FOREIGN PATENT DOCUMENTS 0290853 11/1988 European Pat. Off. .
1236529 3/1937 Germany .
3715536 12/1988 Germany .
9110806 11/1991 Germany .
9115598 6/1992 Germany .

*Primary Examiner*—J. Reed Fisher
*Attorney, Agent, or Firm*—Cohen, Pontani, Lieberman, Pavane

[57] ABSTRACT

A mounting for an impression cylinder, which is equipped with a tube that can be slipped on in a rotary press and which is supported in the operating state laterally and radially by at least three supporting bodies. The bodies can be shifted from the region of an opening in the supporting frame that enables the tubes to be exchanged as well as with respect to the position of the impression cylinder that is to be realized. The supporting bodies are constructed in each case as a roll which supports the impression cylinder over a peripheral bearing surface outside of the seat for the tube and is rotatably disposed on an eccentric bolt mounted in the supporting frame parallel to the axis of the impression cylinder.

31 Claims, 6 Drawing Sheets

MOUNTING FOR AN IMPRESSION CYLINDER EQUIPPED WITH A TUBE

BACKGROUND OF THE INVENTION

1. Field of Invention

The invention relates to a mounting for an impression cylinder equipped with a tube in a rotary press. The impression cylinder is supported in an operating state laterally and radially by at least three supporting bodies which can be shifted from the region of an opening in the supporting frame that enables the tubes to be exchanged, as well as with respect to the position of the impression cylinder that is to be realized.

2. Description of the Related Art

A mounting for an impression cylinder (German patent 37 15 536), for which a jaw chuck is movably held at the print unit side wall, is known. In this reference, a bearing seated on the axle journal of the impression cylinder, is held in an operating state in the jaw chuck. Furthermore, the jaw chuck can be opened up over the diameter of the tube and, in a holding position, can be adjusted for the impression cylinder by adjustable stops.

Including the necessary driving mechanism, the jaw chuck, which can be opened up, requires relatively large space in the radial direction of the impression cylinder. However, only a very limited amount of space is available in the case of a multi-cylinder arrangement in a printing unit. Moreover, the straight-line motion mechanisms for the jaws are relatively expensive to manufacture.

SUMMARY OF THE INVENTION

It is therefore an object of the present invention to provide a mounting of the above-mentioned type for an impression cylinder that is equipped with a tube which can be slipped on. This mounting enables tile tubes in the rotary press to be changed with means that are simple to manufacture and require little space. Furthermore, the mounting is to ensure a functionally reliable, adjustable support for the impression cylinder in the operating state.

Pursuant to this object, and others which will become apparent hereafter, one aspect of the present invention resides in constructing the supporting bodies in each case as a roll which supports the impression cylinder over a peripheral bearing surface outside of the seat for the tube and is rotatably disposed on an eccentric bolt mounted in the supporting frame parallel to the axis of the impression cylinder. The rolls, as well as the means serving for their mounting and adjustment, can be manufactured easily at relatively little expense and do not require much space, so that an appropriate number can be installed even for a multi-cylinder arrangement.

The rolls, which serve for the support as well as the mounting of the impression cylinder, permit the impression cylinder to be mounted simply and without journals.

In a further embodiment the rolls are arranged in pocket-shaped recesses of the supporting frame, which ensures that they are accommodated in the tightest space.

In another embodiment one of tile side walls of the recesses is constructed as an insertable covering segment which permits, the rolls to be installed without any problems.

If for design and manufacturing reasons the recesses cannot be disposed in the supporting frame or if a rotary press is to be retrofitted subsequently with impression cylinders equipped with tubes, the rolls can be disposed on the side of the supporting frame. This is accomplished by an embodiment in which a ring is fixed laterally on the supporting frame and defines pocket-shaped recesses in which the rolls are disposed. A further embodiment provides a separate segment fixed laterally to the supporting frame so as to define pocket-shaped recesses in which the rolls are disposed.

In still a further embodiment, the pocket-shaped recess is a continuous annular groove that is particularly easily manufactured.

According to another embodiment, eccentric bolts are provided for carrying the rolls.

Still another embodiment provides a wall bush for mounting all tile rolls, which makes installation as a complete subassembly possible.

In yet another embodiment, a lever is pivotably connected with tile supporting frame, is linked with a working cylinder and engages an axle journal of the eccentric bolt. This permits the eccentric bolts to be adjusted effectively with few transfer elements in a narrow space and can therefore be used advantageously for a multi-cylinder arrangement in a printing unit.

An adjustable stop can be provided for limiting the swiveling motion of the lever. The stop can consist of a body fastened to the supporting frame and having a tapped hole in which an adjusting screw is located. This enables the rolls in the operating state to be adjusted easily as a function of tile position of the impression cylinder.

In still a further embodiment, the bearing surface of the impression cylinder has an external diameter which is smaller than the internal diameter of the tube and brings about a centering of the tube when it is being pushed onto the impression cylinder. The bearing surface is equipped at the front end of the impression cylinder with a leading slope.

Another embodiment connects a ball race firmly with the impression cylinder. The bearing surface for the rolls being on the ball race.

In order to improve the bearing surface, it can be hardened or coated with a wear layer of metal alloys or non-metallic, inorganic, mechanically resistant materials. The bearing surface can also be sealed with organic materials based on an epoxide resin.

In a further embodiment of the invention, tile rolls are constructed as anti-friction bearings where the outer ring is the bearing surface. The eccentric bolts can be individually adjustable, which brings about a tilting of the rolls and permits an optimum adjustment to tile particular load condition of tile impression cylinder. For example, the two rolls under the greatest load should, as far as possible, be turned on and off simultaneously and in opposite directions.

In an additional embodiment, the eccentric bolts are adjusted individually as a function of the position of the impression cylinder and controlled by a motor, electronically or by a computer. This enables different positions of the impression cylinder to be realized by way of an appropriate radial adjustment of the rolls supporting it.

It is advantageous, in the sense of a uniform distribution of forces on the rolls, to dispose the rolls independently of the load and asymmetrically on the circumference of the impression cylinder.

In an advantageous variation of the driving mechanism for adjusting the eccentric bolts, the bolts are connected with a controllable servomotor via separate worm drives.

In a further embodiment, the eccentric bolts of the rolls supporting the impression cylinder in the region of maximum load can be adjusted synchronously and the eccentric bolts of the roll guiding only the impression cylinder can be adjusted individually. The two synchronously adjustable eccentric bolts are connected with one another by a linkage and one of these eccentric bolts is additionally connected over a worm drive with a controllable servo motor. The eccentric bolt of the roll only guiding the impression cylinder is connected over a lever with a working cylinder, which is operated with an adjustable pressure media.

It is possible, in yet another embodiment, to control the servo motors in each case with the help of sensors that fix the position of the respective eccentric bolt for the impression throw-on and the impression throw-off and for changing the tube of the impression cylinder.

Also the servo motors can be moved in each case against the stops fixing the position of the respective eccentric bolt for the impression throw-on or the impression throw-off and for changing the tube of tile impression cylinder, it thus being possible to swing the middle stop out of the way for the impression throw-off.

DETAILED DESCRIPTION OF THE PREFERRED EMBODIMENTS

Figure 1:
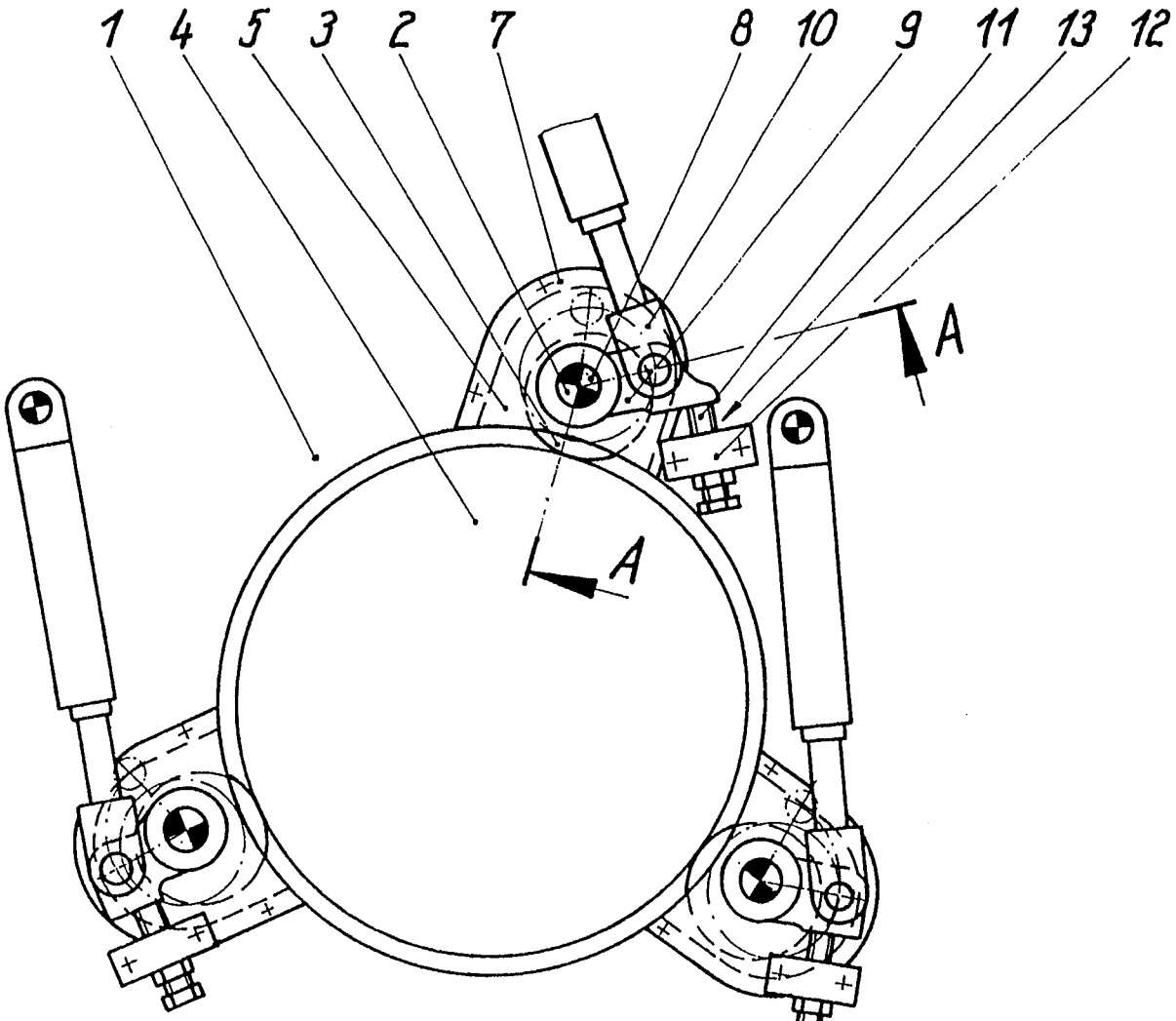
FIG. 1 shows a side view of an inventive arrangement of an impression cylinder, which is equipped with a tube that can be slipped on and supported at the periphery on rolls.

FIG. 1 shows a side view of an impression cylinder 4, supported at its periphery on rolls 3 rotatably disposed on eccentric bolts 2 supported in a supporting frame 1 of a rotary press.

Figure 3:
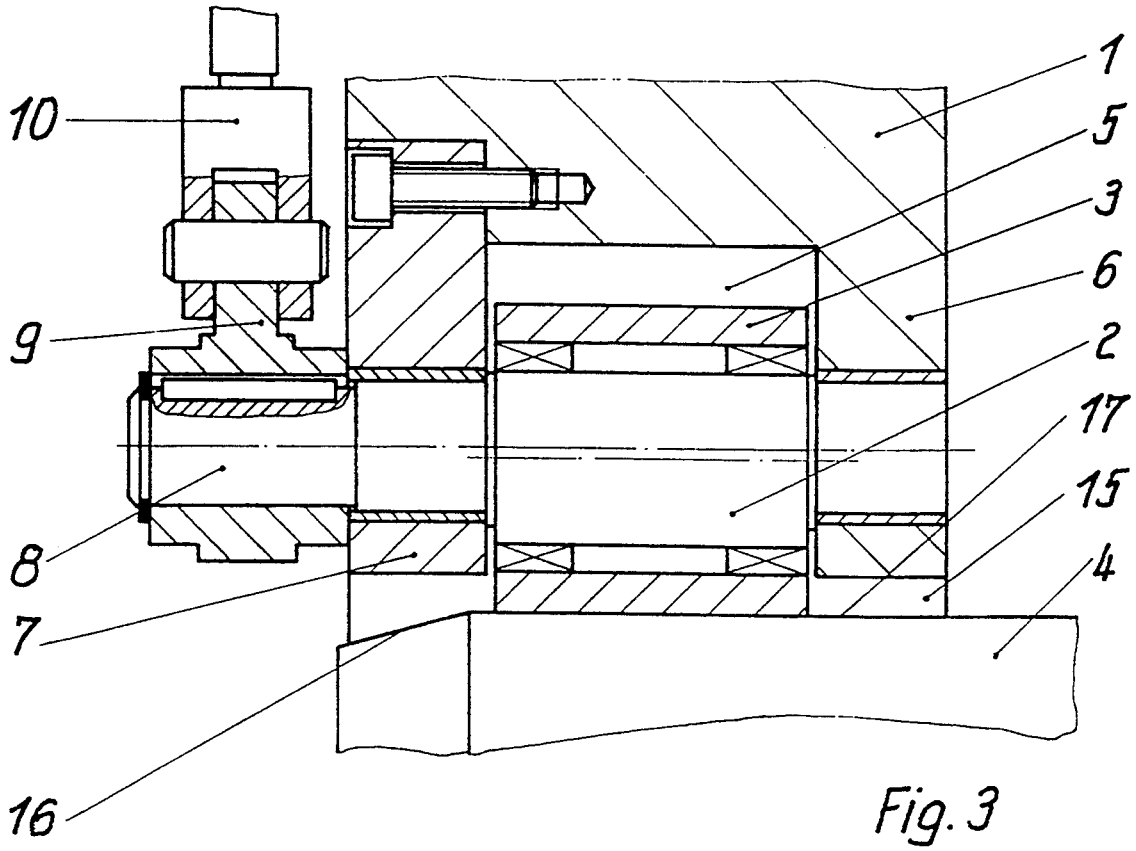
FIG. 3 shows a section along the line A—A of FIG. 1.

The rolls 3 are in each case disposed in a pocket-shaped recess 5 of the supporting frame 1 and the eccentric bolts 2 are supported, on the one hand, in a wall 6 of the supporting frame 1 forming the boundary of the recess 5 and, on the other hand, in a covering segment 7 rigidly inserted in the supporting frame 1 (FIG. 3) and connected with an axle journal 8 outside of the supporting frame 1 with a lever 9. A working cylinder 10, which is pivotally supported in the supporting frame 1 and operated by means of a pressure medium, is linked to the lever 9 (FIG. 1).

The swiveling motion of the lever 9, in the direction bringing about the placement of the rolls 3 against the impression cylinder 4, is limited in each case by a stop 13 consisting of a body 12 fastened to the supporting :frame 1 and penetrated by an adjusting screw 11 in a tapped hole (FIG. 1).

Figure 2:
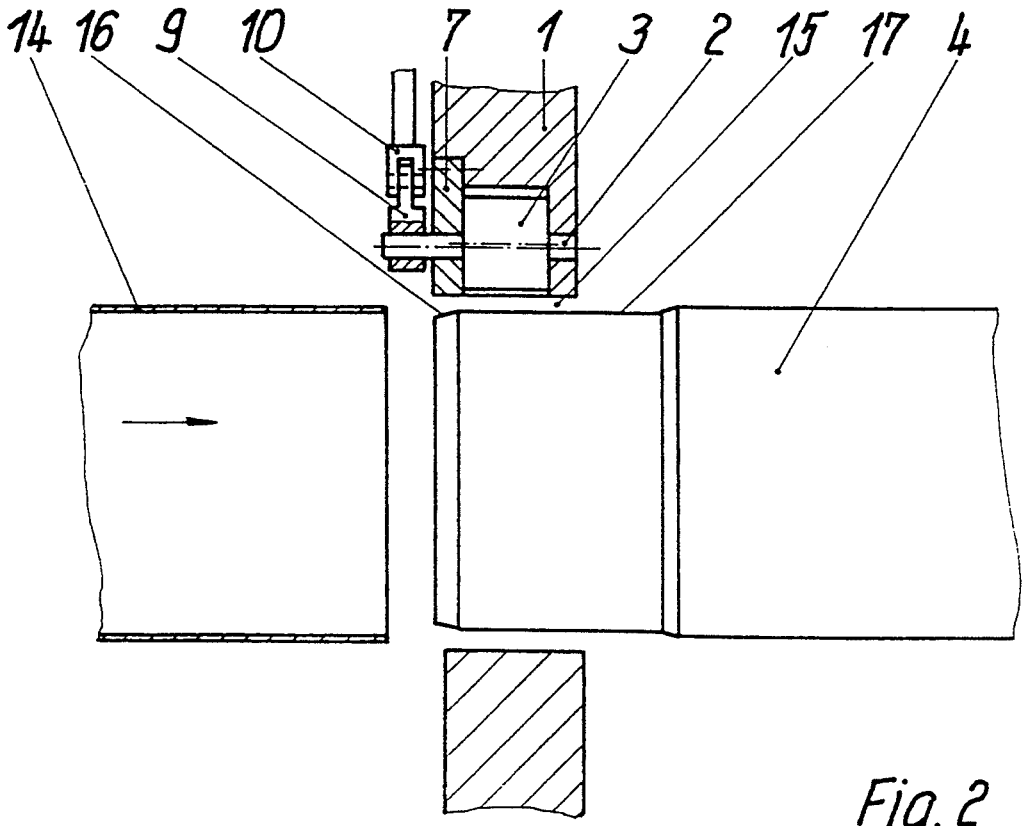
FIG. 2 shows a longitudinal section of the impression cylinder, which is to be equipped with a tube, with the rolls swung out of the way.

FIG. 2 shows an impression cylinder 4 with a tube 14 that can be slipped onto the impression cylinder 4. For this purpose, the rolls 3 are swiveled out of the way by twisting the eccentric bolts 2 from the impression cylinder 4, which is additionally supported for this purpose, on the opposite side that is not shown, so that the opening in the supporting frame 1, in the form of a wall borehole 15 enlarged relative to the external diameter of the tube 14, is exposed.

The impression cylinder 4 is equipped at the periphery of its end faces with a leading slope for the centered pushing-on of the tube 14 and on this side with a bearing surface 17 for the rolls 3, which is set back relative to the internal diameter of the tube 14.

Figure 5:
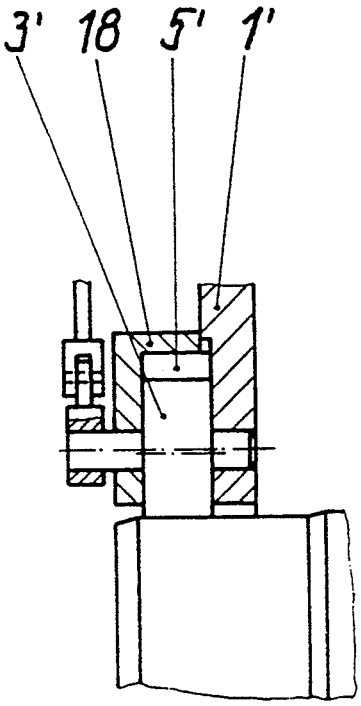
FIG. 5 shows a section along the line B—B of FIG. 4.
Figure 4:
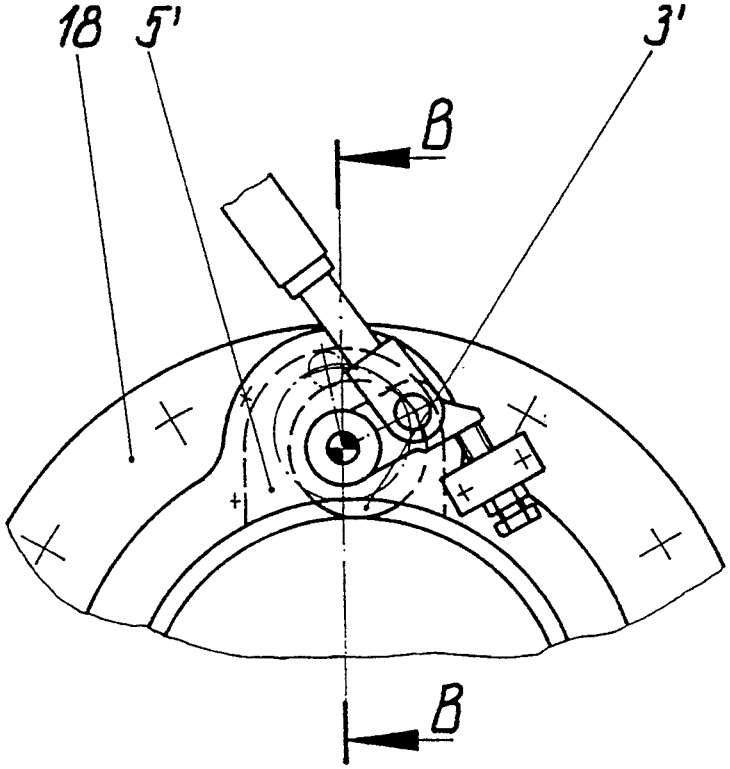
FIG. 4 shows a ring, which is equipped with pocket-like recesses for the rolls and set laterally on a supporting frame, in a sectional side view.

FIGS. 4 and 5 show a ring 18 equipped with, in each case, pocket-shaped recesses 5′ for the rolls 3′ and permanently set laterally on the supporting frame 1′ while retaining its opening.

Figure 7:
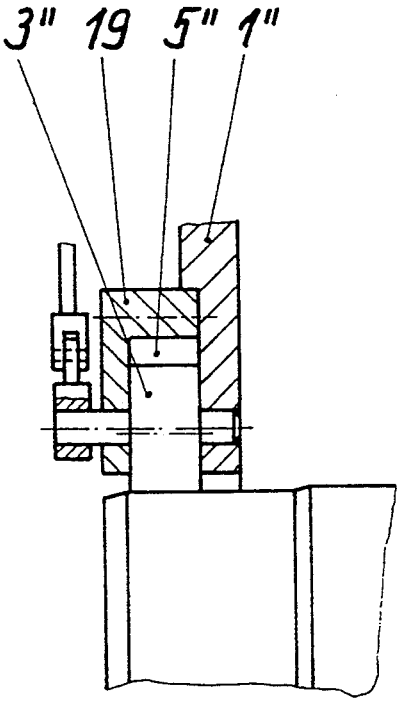
FIG. 7 shows a section along the line C—C of FIG. 6.
Figure 6:
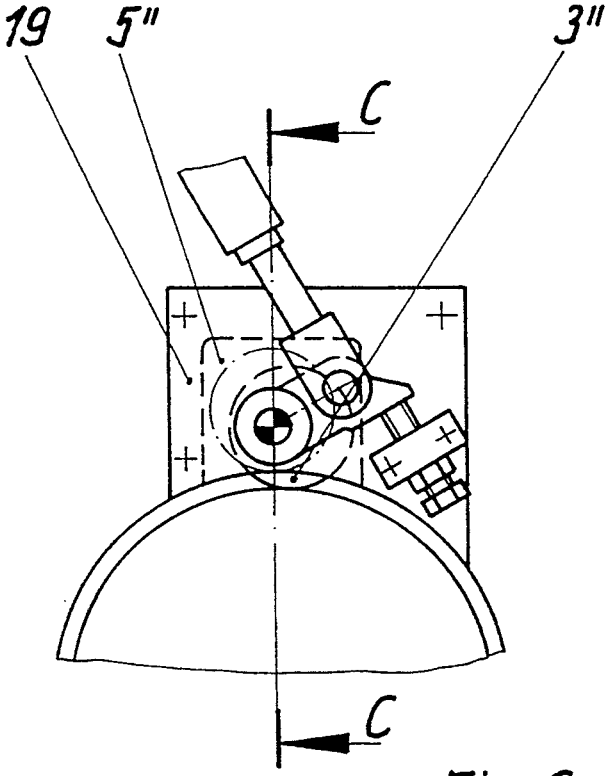
FIG. 6 shows a segment, which is set laterally on a supporting frame and is equipped in each case with one pocket-like recess for a roll.

FIGS. 6 and 7 show a segment 19 firmly placed separately, laterally on the supporting frame 1″ so as to retain its opening, in each case with a pocket-shaped recess 5″ for a roll 3″.

The pocket-shaped recesses 5, 5′ of FIGS. 1 to 4 can also be replaced by a continuous annular groove, which is easy to manufacture, engages all rolls 3, 3′ and is open towards the wall borehole 15.

Figure 8:
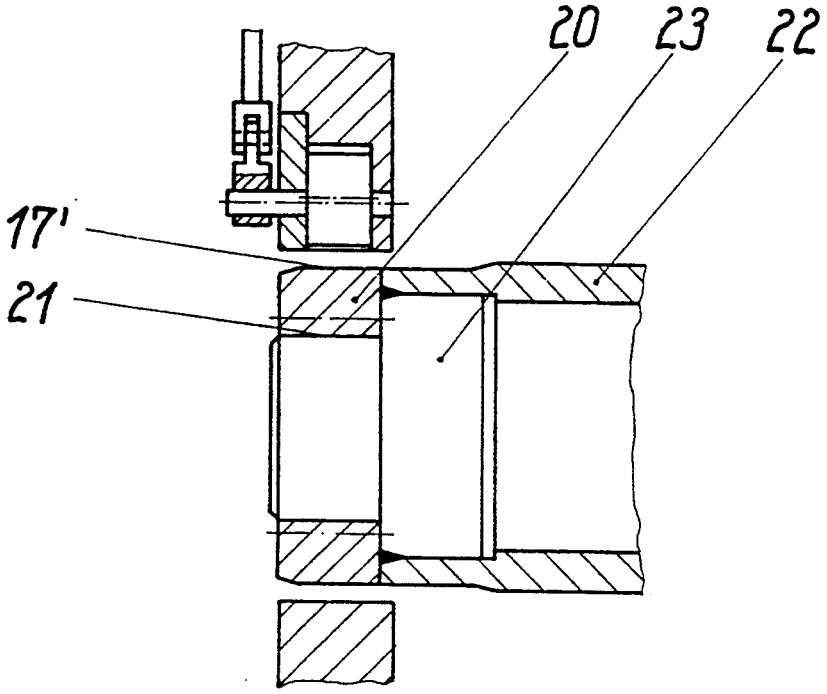
FIG. 8 shows a longitudinal section of an impression cylinder equipped with a bolted-down ball race.
Figure 9:
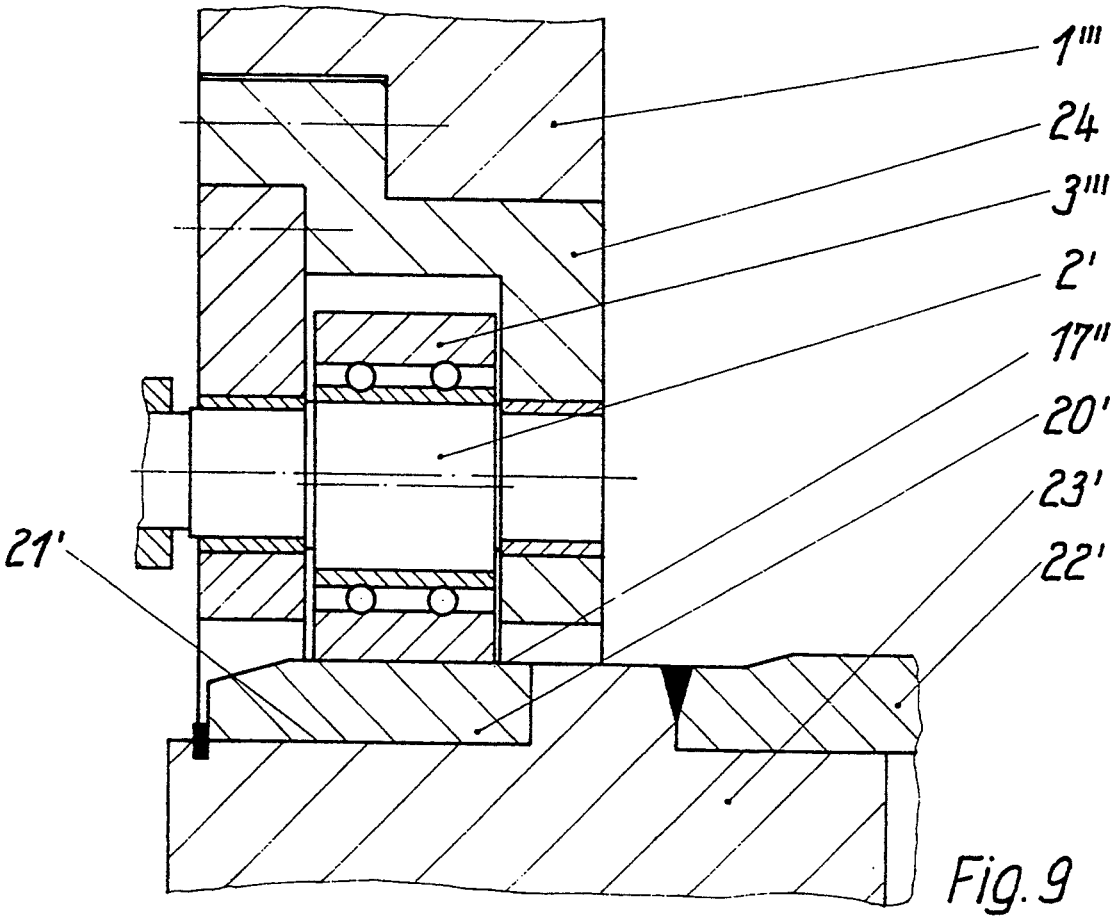
FIG. 9 shows a longitudinal section of an impression cylinder equipped with a pressed-on ball race, as well as with a wall bushing for mounting the rolls.

With respect to optimizing the bearing surface 17′, 17″ for the rolls, it is advantageous to provide a separate ball race 20, 20′, which is firmly connected with the impression cylinder (FIGS. 8 and 9). The ball race 20, 20′ is disposed in FIG. 8 on a rotationally symmetrical shoulder 21 of a bottom 23 pressed at the face end into a tubular shell 22 of the impression cylinder or welded together with the impression cylinder and additionally bolted together with the latter at the face end and, in FIG. 9, pressed onto a corresponding shoulder 21′ of the bottom 23′ and secured additionally by a locking ring.

The bearing surface 17, 17′, 17″ for the rolls 3, 3′, 3″ either can be hardened by using a material suitable for this purpose or coated with an additional wear layer of metallic alloys or non-metallic, mechanically resistant materials, such as ceramic. Optionally, this wear layer can additionally be sealed with organic materials based on epoxide resins.

With regard to a completely installable subassembly, it is advantageous to support the rolls 3‴ with the eccentric bolts 2′ in a wall bushing 24, which has the smallest internal diameter that enables the tubes to be exchanged, is bolted together with the supporting frame 1''' and is inserted coaxially with the impression cylinder in the supporting frame 1''''.

Figure 10:
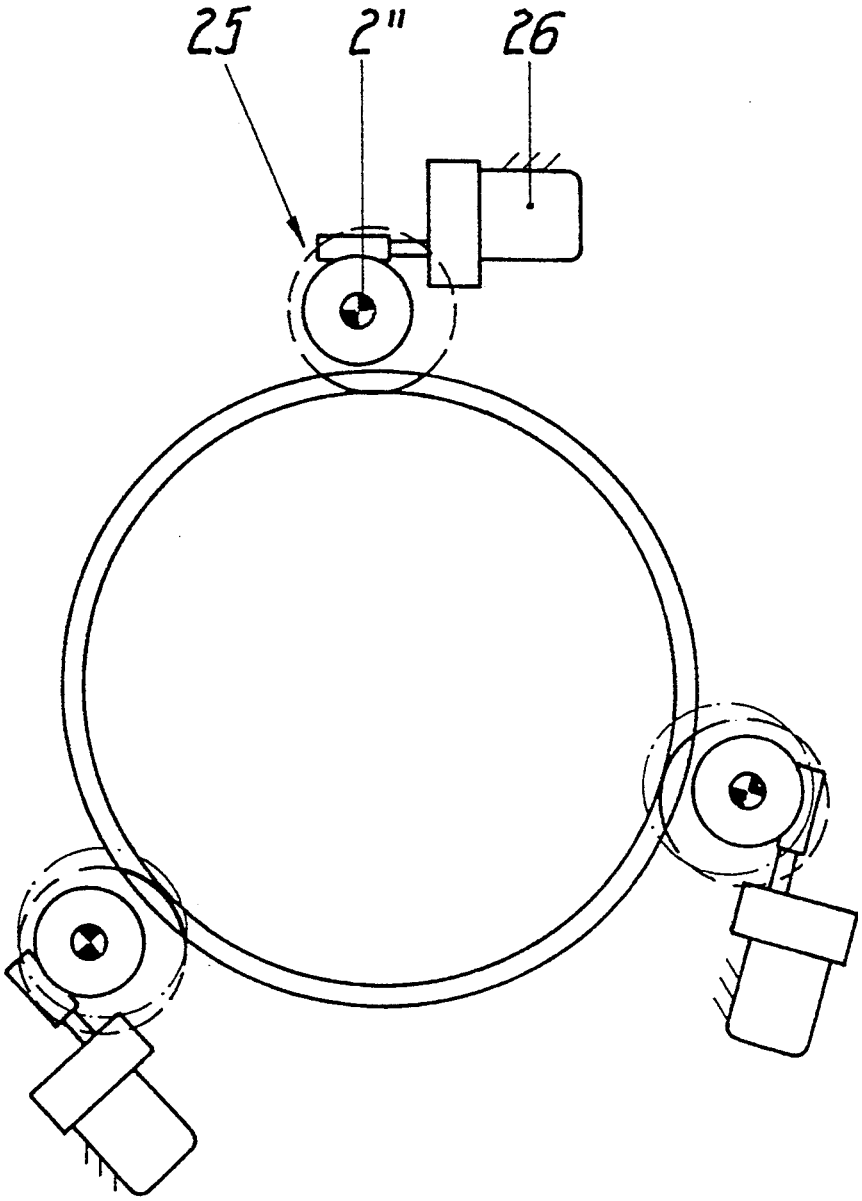
FIG. 10 shows a variation of FIG. 1 with in each case, eccentric bolts for the rolls adjustable by way of a worm drive.

FIG. 10 shows adjustable eccentric bolts 2'', which can be adjusted individually with the help of a worm drive 25 and a servo motor 26 driving the worm drive.

Figure 11:
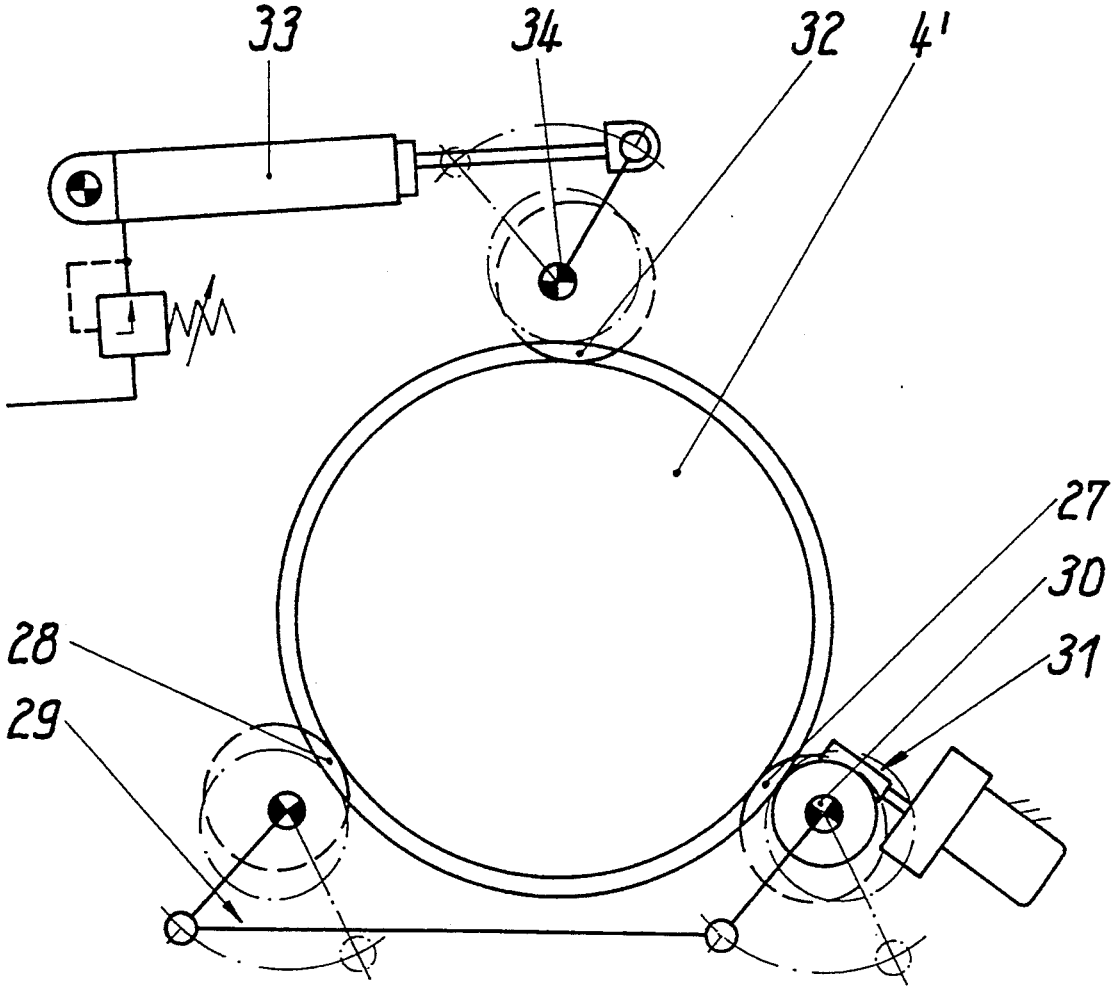
FIG. 11 shows a variation of the driving mechanism for the eccentric bolts, coordinated with the special load on the rolls.

In FIG. 11, rolls 27, 28 are disposed in the region of maximum load at a smaller distance from one another and are connected with one another so as to be synchronously adjustable by a linkage 29, so that only one eccentric bolt 30 must be equipped with a driving mechanism consisting of worm drives 31 and a servo motor. The third roll 32, on which there is only a small load and which is indispensable for guiding the impression cylinder 4'' exactly, is first moved away from and finally placed against the other two rolls 27, 28 with the help of a separate driving mechanism. Advantageously, the pressure medium for the working cylinder 33 is adjustable for this purpose and the adjustment path of the eccentric bolt 34 is not limited by stops.

Figure 12:
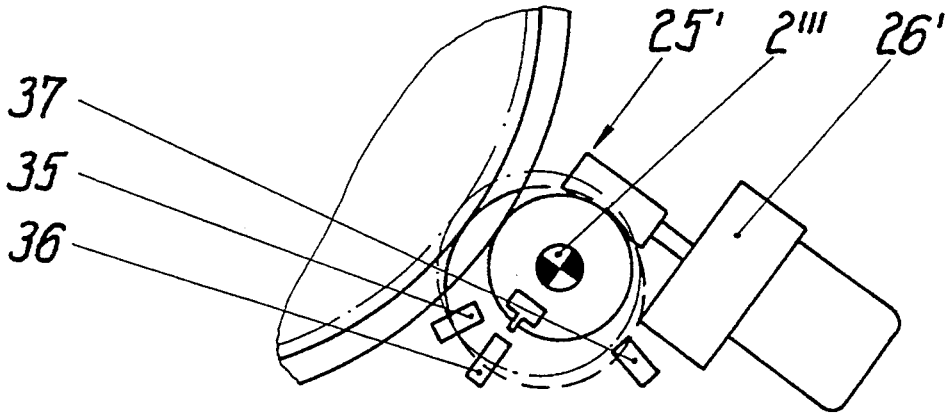
FIG. 12 shows a variation of the driving mechanism of FIG. 10, controlled with the help of sensors.

FIG. 12 shows a variation of FIG. 1.0, for which the servo motors 26' for the individual eccentric bolts 2''' are controlled in each case with tile help of sensors 35, 36, 37 fixing the positions for impression throw-on and throw-off and changing of the tube of the impression cylinder.

As in FIG. 12, the servo motors can also be movable against stops fixing the position for impression throw-on and throw-off and for changing the tube of the impression cylinder; in this case, however, it must be possible to swing the middle stop out of the way for the impression throw-off.

Finally, the possibility also exists of adjusting the two eccentric bolts 2'' individually and independently of the position of tile impression cylinder by driving mechanisms controlled with the help of a computer.

The invention is not limited by the embodiments described above which are presented as examples only but can be modified in various ways within the scope of protection defined by the appended patent claims.

We claim:

1. A mounting for an impression cylinder having a seat on which a tube can be slipped in a rotary press and a peripheral bearing surface outside the seat, comprising: a supporting frame having an opening therein through which the tube can be passed; at least three supporting rolls for supporting the impression cylinder; means for connecting the rolls to the supporting frame so as to support the impression cylinder radially on the peripheral bearing surface, the connecting means including a plurality of eccentric bolts mounted in the supporting frame parallel to the axis of the impression cylinder, each of the supporting rolls being rotatably disposed on one of the eccentric bolts; and means for turning the eccentric bolts so that the rolls shift from a region of the opening in the supporting frame to permit exchange of the tube, and so that the rolls shift with respect to a desired position of the impression cylinder.

2. A mounting as defined in claim 1, wherein the supporting frame has a plurality of pocket-shaped recesses, each of the rolls being disposed in one of the pocket-shaped recesses.

3. A mounting as defined in claim 2, wherein each of the recesses is bounded laterally by a wall connected to the supporting frame.

4. A mounting as defined in claim 1, and further comprising a ring connected laterally on the supporting frame so as to define pocket-shaped recesses, each of the rolls being disposed in one of the pocket-shaped recesses.

5. A bearing as defined in claim 1, and further comprising a plurality of segment members separately and laterally connected to the supporting frame, each of the segment members defining a pocket-shaped recess and each of the rolls being disposed in one of the pocket-shaped recesses.

6. A mounting as defined in claim 2, wherein the pocket-shaped recesses are constructed as a continuous annular groove that engages all tile rolls.

7. A mounting as defined in claim 2, wherein the eccentric bolts are in each case supported in lateral walls of the pocket-shaped recesses.

8. A mounting as defined in claim 6, wherein the eccentric bolts are supported in lateral walls of the annular groove.

9. A mounting as defined in claim 1, wherein the connecting means includes wall bushings mounted in the supporting frame coaxially with the impression cylinder and having a smallest internal diameter that permits the tube to pass through, the rolls being supported in the wall bushings.

10. A mounting as defined in claim 1, wherein each eccentric bolt has an axle journal, the turning means including, for each eccentric bolt, a working cylinder pivotally connected with the supporting frame, and a lever linked to the working cylinder and engaging the axle journal of the eccentric bolt.

11. A mounting as defined in claim 10, wherein the lever is adapted to execute a swiveling motion, and further comprising an adjustable stop connected to the supporting frame so as to limit the swiveling motion of the lever.

12. A mounting as defined in claim 11, wherein the adjustable stop includes a body fastened to the supporting frame and having a tapped hole, and an adjusting screw located in the tapped hole and penetrating the body as to stop the lever.

13. A mounting as defined in claim 1, and further comprising an impression cylinder having a bearing surface with an external diameter that is smaller than an internal diameter of the tube so as to bring about a centering of the tube when it is pushed onto the impression cylinder.

14. A mounting as defined in claim 13, wherein tile bearing surface is equipped at a front end of the impression cylinder with a leading slope.

15. A mounting as defined in claim 1, and further comprising a ball race connected to the impression cylinder, the bearing surface for the rolls being on the ball race.

16. A mounting as defined in claim 15, wherein the impression cylinder has a tubular shell, and further comprising a bottom member inserted laterally in the tubular shell of the impression cylinder, the bottom member having a rotationally symmetrical shoulder on which the ball race is disposed.

17. A mounting as defined in claim 16, wherein the ball race is bolted to the bottom member.

18. A mounting as defined in claim 16, .wherein the ball race is pressed onto the shoulder of the bottom member.

19. A mounting as defined in claim 1, wherein the bearing surface for the rolls is hardened.

20. A mounting as defined in claim 1, wherein the bearing surface is coated with an additional wear layer of one of metal alloys and non-metallic, inorganic, mechanically resistant materials.

21. A mounting as defined in claim 20, wherein the bearing surface is sealed with organic materials based on an epoxide resin.

22. A mounting as defined in claim 1, wherein the rolls are each constructed as an anti-friction bearing having an outer ring as a bearing surface.

23. A mounting as defined in claim 1, wherein the turning means adjusts the eccentric bolts individually at least one of at different times and in opposite directions.

24. A mounting as defined in claim 1, wherein the eccentric bolts are adapted to be individually adjustable as a function of position of the impression cylinder, and further comprising means for controlling adjustment of the eccentric bolts.

25. A mounting as defined in claim 1, wherein the rolls are disposed asymmetrically to the periphery of the impression cylinder at a lesser distance from one another in a radial direction of maximum load from the impression cylinder.

26. A mounting as defined in claim 1, wherein the turning means includes a controllable servo-motor and a worm drive for each eccentric bolt, the worm drive connecting the eccentric bolt to the controllable servo-motor.

27. A mounting as defined in claim 1, wherein the rolls are arranged around the circumference of the impression cylinder so that some are in a region subjected to maximum load of the cylinder and some carry no load and only contact the cylinder, the turning means synchronously adjusts the eccentric bolts of the rolls supporting the impression cylinder in the region of maximum load from the cylinder and individually adjusts the eccentric bolt of the roll only contacting the impression cylinder.

28. A mounting as defined in claim 27, wherein the turning means includes a linkage which connects the synchronously adjustable eccentric bolts with one another, and still further including a servo motor and a worm drive connecting the servo motor to one of these eccentric bolts.

29. A mounting as defined in claim 27, wherein the turning means includes a working cylinder operable with adjustable pressure media, and a lever that connects the eccentric bolt of the roll only contacting the impression cylinder with the working cylinder.

30. A mounting as defined in claim 26, and further comprising sensor means for sensing the position of respective eccentric bolts for impression throw-on and impression throw-off and for changing the tube of the impression cylinder, each of the servo motors being responsive to the sensor means.

31. A mounting as defined in claim 26, and further comprising stop means for fixing the position of respective eccentric bolts for impression throw-on and impression throw-off and for changing the tube of the impression cylinder, the servo motors being movable against the stops, the stop means including a stop member that is swingable so as to not interfere with the impression throw-off.

* * * * *